US009926920B2

(12) United States Patent
Oikawa

(10) Patent No.: US 9,926,920 B2
(45) Date of Patent: Mar. 27, 2018

(54) CRYOPUMP

(71) Applicant: Sumitomo Heavy Industries, Ltd., Tokyo (JP)

(72) Inventor: Ken Oikawa, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 15/087,193

(22) Filed: Mar. 31, 2016

(65) Prior Publication Data

US 2016/0290327 A1 Oct. 6, 2016

(30) Foreign Application Priority Data

Mar. 31, 2015 (JP) ..... 2015-073196

(51) Int. Cl.
*B01D 8/00* (2006.01)
*F04B 37/08* (2006.01)

(52) U.S. Cl.
CPC ..... *F04B 37/08* (2013.01)

(58) Field of Classification Search
CPC ..... F04B 37/08; B01D 8/00
USPC ..... 62/55.5
See application file for complete search history.

(56) References Cited

U.S. PATENT DOCUMENTS 7,523,618 B2 4/2009 Tanaka
8,261,559 B2 9/2012 Tanaka
2013/0312431 A1* 11/2013 Syssoev ..... F04B 37/08 62/55.5

FOREIGN PATENT DOCUMENTS

JP 2010-014066 A 1/2010
JP 2010-048132 A 3/2010
WO WO-2005/050018 A1 6/2005

* cited by examiner

*Primary Examiner* — Len Tran
*Assistant Examiner* — Ana Vazquez
(74) *Attorney, Agent, or Firm* — Michael Best & Friedrich LLP

(57) ABSTRACT

A cryopump includes a top cryopanel that partitions a shield cavity into a shield cavity upper portion and a shield cavity lower portion. A radiation shield includes a shield main slit that communicates a shield outside gap into the shield cavity lower portion. The radiation shield may include a shield auxiliary slit that is formed at a different position from that of the shield main slit in an axial direction of the cryopump and that communicates the shield outside gap into the shield cavity lower portion. The shield auxiliary slit may be formed between the top cryopanel and the shield main slit in the axial direction.

15 Claims, 5 Drawing Sheets

10

10

10

CRYOPUMP

RELATED APPLICATION

Priority is claimed to Japanese Patent Application No. 2015-073196, filed on Mar. 31, 2015, the entire content of which is incorporated herein by reference.

BACKGROUND OF THE INVENTION

1. Field of the Invention

The present invention relates to a cryopump.

2. Description of the Related Art

A cryopump is a vacuum pump trapping gases on a cryogenically-cooled cryopanel by means of condensation or adsorption. The cryopump pumps gases from a vacuum chamber on which the cryopump is mounted.

The cryopump normally includes a first cryopanel cooled at a certain temperature and a second cryopanel cooled at a lower temperature than the certain temperature. The first cryopanel includes a radiation shield. Along with use of the cryopump, a condensing layer of gases grows on the second cryopanel. The condensing layer can eventually contact the radiation shield or a part of the first cryopanel. In this case, gases vaporize again at a contacting part, and pressure in the cryopump increases. Since then, the cryopump cannot play an actual role of pumping of the vacuum chamber sufficiently. Thus, the total amount of gas condensed at the time when the condensing layer contacts the first cryopanel provides a gas capacity limit of the cryopump.

SUMMARY OF THE INVENTION

An exemplary purpose of an embodiment of the present invention is to increase a gas capacity limit of a cryopump.

According to an aspect of the present invention, there is provided a cryopump including: a cryopump housing that includes a cryopump inlet; a refrigerator that includes a high-temperature cooling stage and a low-temperature cooling stage housed in the cryopump housing; a radiation shield that includes a shield main opening at the cryopump inlet, that defines a shield cavity continuing from the shield main opening in an axial direction, that is thermally connected to the high-temperature cooling stage, that receives the low-temperature cooling stage in the shield cavity, and that forms a shield outside gap between the radiation shield and the cryopump housing; and a plurality of cryopanels that are each thermally connected to the low-temperature cooling stage and that are each arranged in the shield cavity in a non-contact state with the radiation shield. The plurality of cryopanels include a top cryopanel that partitions the shield cavity into a shield cavity upper portion and a shield cavity lower portion. The radiation shield further includes a shield main slit that communicates the shield outside gap into the shield cavity lower portion and a shield auxiliary slit that is formed at a different position from that of the shield main slit in the axial direction and that communicates the shield outside gap into the shield cavity lower portion.

According to an aspect of the present invention, there is provided a cryopump including: a cryopump housing that includes a cryopump inlet; a refrigerator that includes a high-temperature cooling stage and a low-temperature cooling stage housed in the cryopump housing; a radiation shield that includes a shield main opening at the cryopump inlet, that defines a shield cavity continuing from the shield main opening in an axial direction, that is thermally connected to the high-temperature cooling stage, that receives the low-temperature cooling stage in the shield cavity, and that forms a shield outside gap between the radiation shield and the cryopump housing; and a plurality of cryopanels that are each thermally connected to the low-temperature cooling stage and that are each arranged in the shield cavity in a non-contact state with the radiation shield. The plurality of cryopanels include a top cryopanel that partitions the shield cavity into a shield cavity upper portion and a shield cavity lower portion and a first lower cryopanel arranged in the shield cavity lower portion. The radiation shield further includes a shield main slit that communicates the shield outside gap into the shield cavity lower portion. The top cryopanel and the radiation shield form a radial-direction gap therebetween. The first lower cryopanel includes a first lower cryopanel outer circumferential end that forms a first radial-direction interspace between the first lower cryopanel outer circumferential end and the radiation shield, and the first radial-direction interspace is wider than the radial-direction gap.

Note that components and expressions of the present invention mutually substituted among a method, an apparatus, a system, and the like are valid as aspects of the present invention.

DETAILED DESCRIPTION OF THE INVENTION

Figure 1:
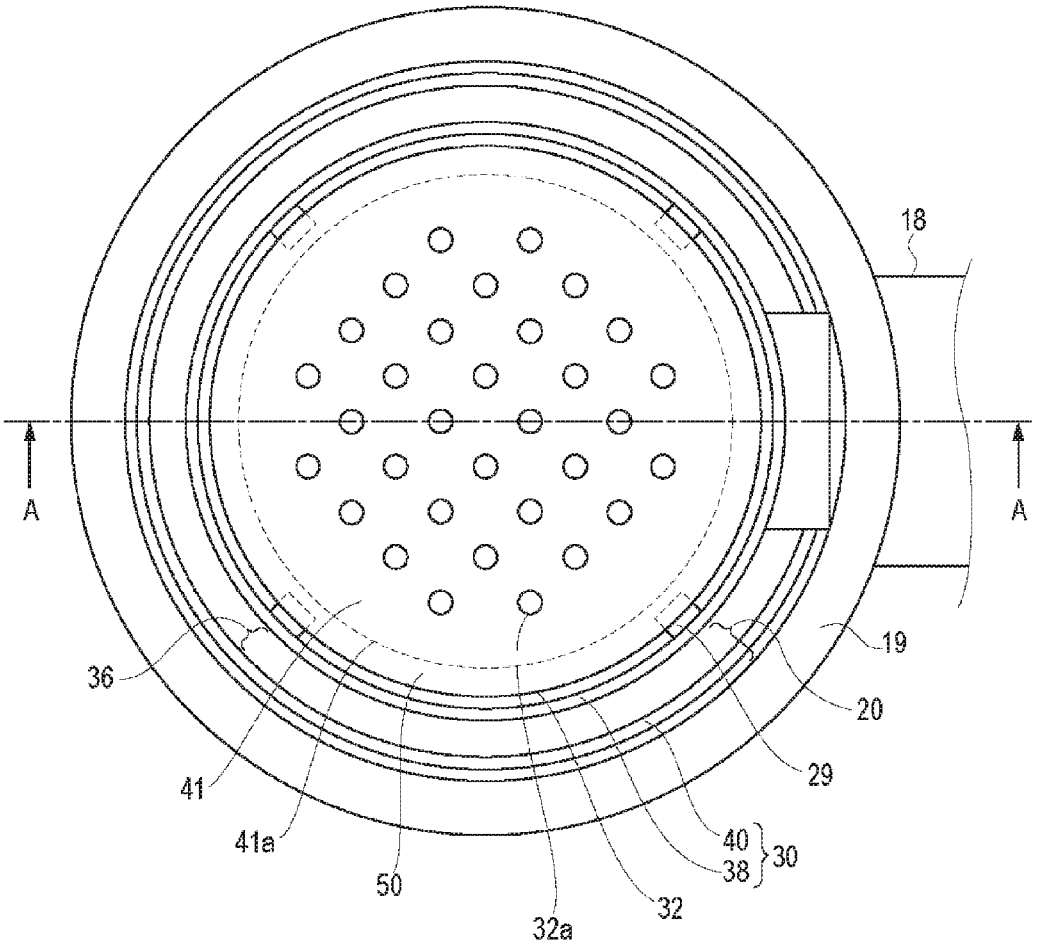
FIG. 1 is an upper view schematically illustrating a main part of a cryopump according to an embodiment of the present invention.

The invention will now be described by reference to the preferred embodiments. This does not intend to limit the scope of the present invention, but to exemplify the invention.

Hereinbelow, embodiments of the present invention will be described in detail with reference to the drawings. Like numerals are used in the description to denote like elements and the description is omitted as appropriate. The structure described below is by way of example only and does not limit the scope of the present invention.

First, background by which an embodiment of the present invention has been reached and overview of the embodiment will be described.

In a cryopump including a plurality of second cryopanels, each second cryopanel has different speed of growth of a condensing layer depending on an arranging position thereof. In a case of a second cryopanel arranged close to a gas inlet such as a cryopump inlet, a large amount of gas can reach the second cryopanel from the gas inlet, and the condensing layer to be deposited on the second cryopanel can thus grow fast. Conversely, the condensing layer to be deposited on another second cryopanel away from the gas inlet can grow slowly.

The plurality of second cryopanels may include a top cryopanel opposed to the cryopump inlet. The top cryopanel may be a large-sized flat-plate-like member disposed in a cavity in a radiation shield so as to partition the cavity into a cavity upper portion on a side of the cryopump inlet and a cavity lower portion on an opposite side. The top cryopanel, or an outer circumference of the top cryopanel in particular, does not contact the radiation shield to keep a temperature difference. Since the cavity upper portion directly receives gases from the inlet, the condensing layer grows fast on a front face of the top cryopanel. On the other hand, the condensing layer grows slowly in the cavity lower portion. Accordingly, when the condensing layer that has grown in the cavity upper portion contacts the radiation shield, the cavity lower portion may still contain a space around the condensing layer.

In this way, when the condensing mass that has grown in a certain place contacts the first cryopanel, a space, that is, volume that can accommodate the condensing layer, may still be left between the condensing layer and the first cryopanel in another place. This means that the cryopump still has a potential capacity at a gas capacity limit thereof.

By reducing unused spaces and increasing a use rate of an internal space of the cryopump, the gas capacity limit of the cryopump can be improved. Ideally, in a case in which the condensing substance contacts the first cryopanel at the same time in every place, there are no unused spaces at this time (that is, the cryopump is fully filled with the condensing substances), and the gas capacity limit of the cryopump is maximized.

To reduce the spaces, it is desirable to decrease the difference in growth speed of the condensing layer in each second cryopanel, that is, to equalize the growth speed of the condensing layer. Additionally or instead, it is desirable to adjust the adjacent accommodation volume of the condensing layer per second cryopanel in accordance with the growth speed of the condensing layer on the second cryopanel.

A main factor in determining the growth speed of the condensing layer on a certain second cryopanel is an opening area of a gas inlet corresponding to the second cryopanel. For example, when the gas inlet is large, the condensing layer grows fast. Also, the growth speed of the condensing layer is influenced by relative positional relationship between the gas inlet and the second cryopanel (for example, a distance between the gas inlet and the second cryopanel and/or an angular position of the second cryopanel with respect to the gas inlet). For example, when the second cryopanel is close to the gas inlet, the condensing layer grows fast. When the angular position of the second cryopanel is close to the normal line of the gas inlet, the condensing layer grows fast.

According to an embodiment of the present invention, a cryopump is designed so that condensing layers may grow on a second cryopanel and another second cryopanel at substantially equalized speed. For example, the equalized growth speed of the condensing layer is provided to a top cryopanel and a second cryopanel arranged in a cavity lower portion of a shield. In another example, the equalized growth speed of the condensing layer is provided to a second cryopanel and another second cryopanel arranged in the cavity lower portion of the shield. For example, in an embodiment, gas entry paths into the cavity lower portion of the shield and/or arranging positions of the cryopanels in the cavity lower portion of the shield are designed to equalize the growth speed of the condensing layer.

Also, when the growth speed of the condensing layer on a second cryopanel is high, a large accommodation volume of the condensing layer may be formed around the second cryopanel. So as to achieve this, geometric relative arrangement (for example, a distance between the cryopanels and/or an angle between the cryopanels) between the second cryopanel and another cryopanel (the first cryopanel and/or another second cryopanel) may be determined.

By doing so, the unused capacity of the cryopump can actually be used, and the use rate of the internal space of the cryopump can be improved. Accordingly, the gas capacity limit of the cryopump can be improved.

Figure 2:
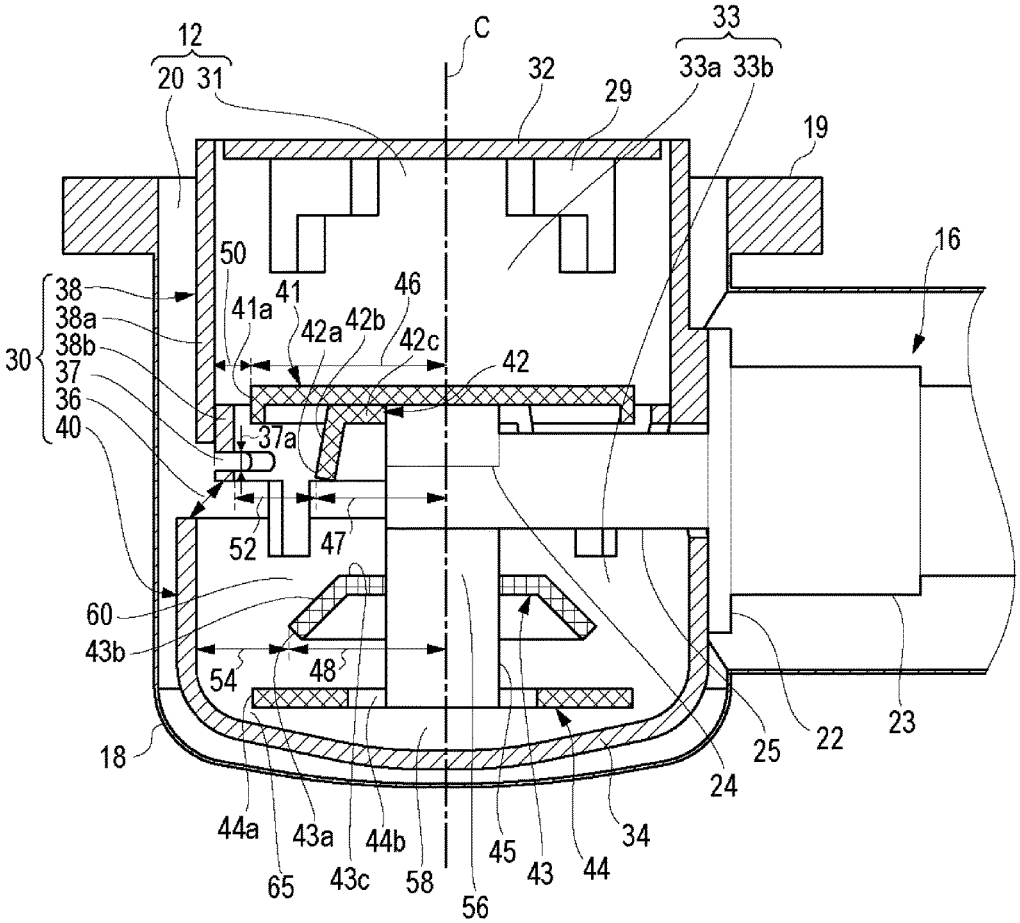
FIG. 2 schematically illustrates the cryopump illustrated in FIG. 1 along the line A-A cross-section.

FIG. 1 is an upper view schematically illustrating a part of a cryopump 10 according to an embodiment of the present invention. FIG. 2 schematically illustrates a cross-section of the cryopump 10 along the line A-A illustrated in FIG. 1.

The cryopump 10 is mounted on a vacuum chamber of, for example, a vacuum processing apparatus and used to increase the degree of vacuum inside the vacuum chamber to a level demanded by a desired process. The vacuum processing apparatus on which the cryopump 10 is mounted is a sputtering apparatus, for example.

The cryopump 10 includes an inlet 12 to receive gases. Gases to be pumped flow from the vacuum chamber on which the cryopump 10 is mounted, through the inlet 12, into an internal space of the cryopump 10.

Note that terms "axial direction" and "radial direction" may be used herein to facilitate an understanding of a positional relationship among components of the cryopump 10. The axial direction represents a direction through the inlet 12 (a direction along the dashed-dotted line representing a central axis C in FIG. 2), and the radial direction represents a direction along the inlet 12 (a direction perpendicular to the central axis C). For convenience, relative closeness to the inlet 12 in the axial direction may be described by terms such as "upper," "upward," and "above," and relative remoteness therefrom may be described by terms such as "lower," "downward," and "below." In other words, relative remoteness from the bottom of the cryopump 10 may be described by terms such as "upper" and "upward," and relative closeness thereto may be described by terms such as "lower" and "downward," both in the axial direction. Relative closeness to a center (the central axis C in FIG. 2) of the inlet 12 in the radial direction may be described by terms such as "inner" and "inside," and relative closeness to the circumference of the inlet 12 in the radial direction may be described by terms such as "outer" and "outside." It should be noted here that these terms are not related to a position of the cryopump 10 as mounted on a vacuum chamber. For example, the cryopump 10 may be mounted on a vacuum chamber with the inlet 12 facing downward in the vertical direction.

Also, a direction surrounding the axial direction may be described by a term such as "a circumferential direction." The circumferential direction is a second direction along the inlet 12 and a tangential direction orthogonal to the radial direction.

The cryopump 10 includes a refrigerator 16, at least one first cryopanel, at least one second cryopanel, and a cryopump housing 18.

The refrigerator 16 is a cryogenic refrigerator, such as a Gifford-McMahon type refrigerator (generally called a GM refrigerator). The refrigerator 16 is a two-stage refrigerator including a first stage 22, a first cylinder 23, a second stage 24, and a second cylinder 25. The first cylinder 23 connects a room temperature portion of the refrigerator 16 to the first stage 22. The second cylinder 25 is a connecting portion connecting the first stage 22 to the second stage 24.

The cryopump 10 illustrated in the figure is a so-called horizontal-type cryopump. A horizontal-type cryopump is generally a cryopump arranged such that the refrigerator 16 intersects (orthogonally in general) with the central axis C of the cryopump 10. The refrigerator 16 is arranged such that the first cylinder 23, the first stage 22, the second cylinder 25, and the second stage 24 of the refrigerator 16 line up in this order along the radial direction of the cryopump 10.

The present invention is also applicable to a vertical-type cryopump in a similar manner. A vertical-type cryopump is a cryopump with a refrigerator arranged along the axial direction of the cryopump.

The refrigerator 16 is configured to cool the first stage 22 to a first cooling temperature and cool the second stage 24 to a second cooling temperature. The second cooling temperature is lower than the first cooling temperature. Thus, the first stage 22 and the second stage 24 can also be referred to as a high-temperature cooling stage and a low-temperature cooling stage, respectively.

The first stage 22 is thermally connected to the first cryopanel and cools the first cryopanel to the first cooling temperature. The second stage 24 is thermally connected to the second cryopanel and cools the second cryopanel to the second cooling temperature. For example, the first stage 22 and the first cryopanel are cooled to approximately 65 K to 120 K, and preferably to 80 K to 100 K, while the second stage 24 and the second cryopanel are cooled to approximately 10 K to 20 K.

The cryopump housing 18 is a chassis of the cryopump 10 accommodating the first cryopanel and the second cryopanel. The cryopump housing 18 also accommodates a low temperature portion of the refrigerator 16, that is, the first cylinder 23, the first stage 22, the second cylinder 25, and the second stage 24. The cryopump housing 18 is a vacuum vessel configured to gas-tightly maintain the internal space. The cryopump housing 18 is attached to the room temperature portion of the refrigerator 16.

The cryopump housing 18 includes an inlet flange 19 defining the inlet 12. The inlet flange 19 extends outward in the radial direction from a front end around the entire circumference of the cryopump housing 18. The cryopump 10 is attached to the vacuum chamber with use of the inlet flange 19.

The first cryopanel includes a radiation shield 30 and an inlet cryopanel (for example, a plate member 32). The radiation shield 30 includes a shield main opening 31. The shield main opening 31 is included in the inlet 12 in a planar view. The radiation shield 30 defines a shield cavity 33 therein. The shield cavity 33 continues from the shield main opening 31 in the axial direction. The radiation shield 30 includes a shield bottom portion 34 on an opposite side of the shield main opening 31 in the axial direction. The shield cavity 33 terminates at the shield bottom portion 34. Details of the radiation shield 30 will be described later.

The inlet cryopanel is provided at the shield main opening 31 to protect the second cryopanel from radiant heat emitted from a heat source outside the cryopump 10. The heat source outside the cryopump 10 is, for example, a heat source inside the vacuum chamber on which the cryopump 10 is mounted. Also, gases (for example, moisture) that condense at the first cooling temperature are trapped on a surface of the inlet cryopanel.

The inlet cryopanel also limits the entry of molecules of gases, in addition to the radiant heat, into the shield cavity 33. The inlet cryopanel occupies a part (for example, a large part) of an opening area of the inlet 12 so as to limit a flow of gases through the shield main opening 31 into the shield cavity 33 to a desired quantity.

The inlet cryopanel includes an orifice member forming an inlet opening portion in the shield main opening 31. The inlet opening portion is at least one opening (for example, a pore 32*a*) formed in the porous member. The porous member may be a single plate member 32 covering the shield main opening 31. The inlet cryopanel may include a plurality of small plates or louvers or chevrons formed in a concentric or lattice pattern, instead of the single plate member 32.

The radiation shield 30 extends upward in the axial direction over the inlet flange 19, and the inlet cryopanel is thus located above the inlet flange 19 in the axial direction. Accordingly, the front end of the radiation shield 30 and the inlet cryopanel are located outside the cryopump housing 18. In this way, the radiation shield 30 extends toward the vacuum chamber on which the cryopump 10 is mounted. By extending the radiation shield 30 upward, the shield cavity 33 or the accommodation volume of the condensing layer can be large in the axial direction. However, the length of the extending part in the axial direction is determined so as not to interfere with the vacuum chamber (or a gate valve between the vacuum chamber and the cryopump 10).

The plate member 32 is a single flat plate (for example, a disk) across the shield main opening 31. A dimension (for example, a diameter) of the plate member 32 approximately corresponds to a dimension of the shield main opening 31. There may be a slight gap between the front end of the radiation shield 30 and the plate member 32 in the axial direction and/or in the radial direction.

A front face of the plate member 32 is exposed to an outside space of the cryopump 10. A large number of pores 32*a* penetrate the plate member 32 in order to allow the gases to flow from the outside to the inside of the cryopump 10. The plate member 32 illustrated in the figure has the pores 32*a* at a center portion thereof and does not have the pores 32*a* at an outer circumferential portion thereof. However, the pores 32*a* may be provided at the outer circumferential portion of the plate member 32. The pores 32*a* are regularly arranged. The pores 32*a* are provided at regular intervals respectively in two orthogonal linear directions to form a lattice of the pores 32*a*. Alternatively, the pores 32*a* may be provided at regular intervals respectively in the radial and circumferential directions.

The pores 32*a* are formed, for example, in a circular shape. However, the shape is not limited to this, and the pores 32*a* may be openings formed in a rectangular shape or in another shape, slits extending in a linear form or in a curved form, or cut-outs formed at the outer circumferential portion of the plate member 32. Each of the pores 32*a* is obviously smaller than the shield main opening 31.

The plate member 32 is attached at the outer circumferential portion thereof to joint blocks 29. The joint blocks 29 are each a protrusion extending from the front end of the radiation shield inward in the radial direction and are formed at regular intervals (for example, every 90°) in the circumferential direction. The plate member 32 is fixed to the joint blocks 29 in an appropriate manner. For example, the joint blocks 29 and the plate member 32 each have a bolt hole (not shown) to allow the plate member 32 to be bolted onto the joint blocks 29.

A back face of the plate member 32 and an inner surface of the radiation shield 30 may be subject to a surface treatment for raising a radiation factor such as a black-body treatment. By doing so, the radiation factor of the back face of the plate member 32 and the inner surface of the radiation shield 30 is approximately equal to 1. The black surface may be formed by black chromium plating on a surface of a copper base member or by black painting. Such a black surface is useful to absorb heat entering the cryopump 10.

On the other hand, the front face of the plate member 32 and the second cryopanel may be subject to a surface treatment for lowering the radiation factor to reflect radiant heat emitted from an outside. Such a surface having a low radiation factor may be formed by nickel plating on a surface of a copper base member, for example.

The second cryopanel includes a top cryopanel 41, a first lower cryopanel 42, a second lower cryopanel 43, a bottom cryopanel 44, and a connection cryopanel 45 although details thereof will be described later. These components of the second cryopanel are arranged in the shield cavity 33 to be thermally connected to the second stage 24 and not to contact the radiation shield 30 and the plate member 32. The top cryopanel 41 partitions the shield cavity 33 into a shield cavity upper portion 33*a* and a shield cavity lower portion 33*b*.

The first stage 22 of the refrigerator 16 is attached directly to an outer surface of a side portion of the radiation shield 30. In this way, the radiation shield 30 is thermally connected to the first stage 22 and is thus cooled at the first cooling temperature. Note that the radiation shield 30 may be attached to the first stage 22 via an arbitrary heat transfer member. Also, the second stage 24 and the second cylinder 25 of the refrigerator 16 are inserted into the shield cavity 33 from the side portion of the radiation shield 30. In this way, the radiation shield 30 receives the second stage 24 into the shield cavity 33.

The radiation shield 30 is provided to protect the second cryopanel from radiant heat emitted from the cryopump housing 18. The radiation shield 30 is located between the cryopump housing 18 and the second cryopanel, and encloses the second cryopanel. The radiation shield 30 has a slightly shorter diameter than that of the cryopump housing 18. Accordingly, a shield outside gap 20 is formed between the radiation shield 30 and the cryopump housing 18, and the radiation shield 30 does not contact the cryopump housing 18.

The radiation shield 30 includes at the side portion thereof at least one sub-opening. The sub-opening communicates the shield outside gap 20 into the shield cavity 33. For example, the radiation shield 30 includes a shield main slit 36 and at least one shield auxiliary slit 37. The shield auxiliary slit 37 is formed at a different position from that of the shield main slit in the axial direction. The shield main slit 36 and the shield auxiliary slit 37 individually communicate the shield outside gap 20 into the shield cavity lower portion 33*b*. The plurality of these gas inlets help equalization of the growth speed of the condensing layer in the shield cavity lower portion 33*b*.

The shield main slit 36 may be one or more circumferential-direction elongated openings formed at a position of the radiation shield 30 in the axial direction. A plurality of elongated openings may be formed discretely in the circumferential direction. Similarly, the shield auxiliary slit 37 may be one or more circumferential-direction elongated openings formed at a position of the radiation shield 30 in the axial direction.

The shield auxiliary slit 37 is formed between the top cryopanel 41 and the shield main slit 36 in the axial direction. Such an auxiliary gas inlet guides gases from the shield outside gap 20 to a vacant space formed directly below the top cryopanel 41 (that is, an upper region out of the shield cavity lower portion 33*b*). The shield auxiliary slit 37 helps equalization of the growth speed of the condensing layer in the shield cavity lower portion 33*b*.

The radiation shield 30 includes a plurality of parts and is formed in a cylindrical shape as a whole. The radiation shield 30 includes a shield upper portion 38 and a shield lower portion 40. The shield upper portion 38 is a cylinder opened at both ends and encloses the shield cavity upper portion 33*a*. The shield lower portion 40 is a bottomed cylinder having the shield bottom portion 34 and encloses the shield cavity lower portion 33*b*. Note that the radiation shield 30 may be a single bottomed cylindrical member having the shield main slit 36.

The shield main slit 36 is defined between a lower end of the shield upper portion 38 and an upper end of the shield lower portion 40. The shield main slit 36 is located at a center portion in the axial direction and encompasses the second stage 24 of the refrigerator 16 in the circumferential direction.

The shield main slit 36 has a main slit width while the shield auxiliary slit 37 has an auxiliary slit width 37*a*. The main slit width is longer than the auxiliary slit width 37*a*. Here, the slit width is a dimension of a slit in a direction perpendicular to the circumferential direction (for example, a slit width illustrated with the double-headed arrow in FIG. 2). For example, the main slit width may be a distance between the lower end of the shield upper portion 38 and the upper end of the shield lower portion 40. The auxiliary slit width 37*a* may be a dimension of the shield auxiliary slit 37 in the axial direction.

A diameter of the shield upper portion 38 is shorter than a diameter of the shield lower portion 40 in some degree. The lower end of the shield upper portion 38 is located further above in the axial direction than the upper end of the shield lower portion 40. By doing so, the shield main slit 36 is exposed to the inlet 12. Thus, the amount of gas entering from the inlet 12 through the shield outside gap 20 into the shield main slit 36 can be increased. Since this can accelerate the growth speed of the condensing layer in the shield cavity lower portion 33*b*, the growth speed of the condensing layer in the shield cavity lower portion 33*b* can be similar to that in the shield cavity upper portion 33*a*.

Note that the shield upper portion 38 may have an equal diameter to that of the shield lower portion 40 or may have a longer diameter. Also, the shield upper portion 38 may be inserted into the shield lower portion 40, and the lower end of the shield upper portion 38 may be located further below in the axial direction than the upper end of the shield lower portion 40. The shield main slit 36 may be located above or below the refrigerator 16 in the axial direction.

The shield upper portion 38 is separated into two members, that is, a shield upper portion main body 38*a* and a shield ring member 38*b*. The shield ring member 38*b* is attached to a lower end of the shield upper portion main body 38*a* in the axial direction and extends in the circumferential direction. The shield ring member 38*b* is a connection member connecting the shield upper portion main body 38*a* to the shield lower portion 40 in the axial direction. The shield auxiliary slit 37 is provided to penetrate the shield ring member 38*b*. Such a separated configuration can provide manufacturing advantages. For example, by attaching the shield ring member 38*b* to a radiation shield that does not include the shield auxiliary slit 37, the shield auxiliary slit 37 can be added.

Note that the shield upper portion 38 may be a single member. The shield auxiliary slit 37 may be formed at the shield lower portion 40. At least either the shield upper portion 38 or the shield lower portion 40 may be provided with a plurality of shield auxiliary slits 37.

The top cryopanel 41 is a disc-like member arranged perpendicularly to the axial direction. A front face of the top cryopanel 41 is opposed to the back face of the plate member 32 with the shield cavity upper portion 33*a* interposed therebetween. A center portion of the top cryopanel 41 is attached directly to an upper surface of the second stage 24 of the refrigerator 16. The second stage 24 is located at a center portion of the shield cavity 33 of the cryopump 10. In this way, the shield cavity upper portion 33*a* provides a large accommodation volume of the condensing layer. The front face of the top cryopanel 41 is not provided with an adsorbent such as activated charcoal. Note that a back face of the top cryopanel 41 may be provided with an adsorbent.

The top cryopanel 41 is relatively large. A radial-direction distance 46 from a center of the top cryopanel 41 to a top cryopanel outer circumferential end 41*a* is 70% or higher of a radial-direction distance from a center of the shield main opening 31 to the front end of the radiation shield 30. That is, a radius of the top cryopanel 41 is 70% or higher of a radius of the shield main opening 31. Also, a diameter of the top cryopanel 41 is 98% or lower of a diameter of the shield main opening 31. In this way, the top cryopanel 41 can reliably be in a non-contact state with the radiation shield 30. An axial-direction projected area of the top cryopanel 41 may be 50% to 95% of that of the shield main opening 31, and may preferably be 73% to 90%.

The top cryopanel 41 and the radiation shield 30 form a radial-direction gap 50 therebetween. The radial-direction gap 50 is formed between the top cryopanel outer circumferential end 41*a* and the shield upper portion 38 (for example, the shield upper portion main body 38*a*). The top cryopanel outer circumferential end 41*a* is located above the shield main slit 36 in the axial direction. Since the top cryopanel 41 is a flat plate perpendicular to the axial direction, the entire top cryopanel 41 is located above the shield main slit 36 in the axial direction.

The other components of the second cryopanel except the top cryopanel 41, that is, the first lower cryopanel 42, the second lower cryopanel 43, the bottom cryopanel 44, and the connection cryopanel 45, are arranged in the shield cavity lower portion 33*b*.

Respective centers of the top cryopanel 41, the first lower cryopanel 42, the second lower cryopanel 43, and the bottom cryopanel 44 are on the central axis C of the cryopump 10. The top cryopanel 41, the first lower cryopanel 42, the second lower cryopanel 43, and the bottom cryopanel 44 are arranged coaxially. The connection cryopanel 45 is arranged along the central axis C on both sides of the central axis C.

The first lower cryopanel 42 and the second lower cryopanel 43 are arranged below the top cryopanel 41. The first lower cryopanel 42 is arranged between the top cryopanel 41 and the bottom cryopanel 44 in the axial direction. The second lower cryopanel 43 is arranged between the first lower cryopanel 42 and the bottom cryopanel 44 (or the shield bottom portion 34) in the axial direction.

Each of these two cryopanels has a different shape from that of the top cryopanel 41. The first lower cryopanel 42 has a shape of the side surface of a truncated cone, i.e., an umbrella-like shape. The second lower cryopanel 43 similarly has the umbrella-like shape. An adsorbent such as activated charcoal is provided on each of the lower cryopanels. The adsorbent is, for example, attached to the back face of each of the lower cryopanels. The front face of each of the lower cryopanels functions as a condensing surface while the back face functions as an adsorbing surface.

The first lower cryopanel 42 has a first radius 47 while the second lower cryopanel 43 has a second radius 48. The second radius 48 is longer than the first radius 47. That is, the second lower cryopanel 43 is a larger umbrella-like cryopanel than the first lower cryopanel 42.

However, each of the first lower cryopanel 42 and the second lower cryopanel 43 has a shorter diameter than that of the top cryopanel 41. The first lower cryopanel 42 is arranged further inward in the radial direction than a tangent line 66 to the top cryopanel outer circumferential end 41*a* parallel to the axial direction (a projected line to the top cryopanel 41 parallel to the axial direction) (refer to FIG. 4). The second lower cryopanel 43 is arranged further inward in the radial direction than the tangent line 66 to the top cryopanel outer circumferential end 41*a* parallel to the axial direction. Similarly, each of the first lower cryopanel 42 and the second lower cryopanel 43 has a shorter diameter than that of the bottom cryopanel 44.

The first lower cryopanel 42 and the radiation shield 30 forma first radial-direction interspace 52 therebetween. The first radial-direction interspace 52 is formed between a first lower cryopanel outer circumferential end 42*a* and the shield upper portion 38 (for example, the shield ring member 38*b*). The first radial-direction interspace 52 is longer than the radial-direction gap 50. In this way, a relatively large annular accommodation volume of the condensing layer is formed directly below the top cryopanel 41 in the axial direction. This volume is part of the shield cavity lower portion 33*b*.

This vacant space communicates into the shield cavity upper portion 33*a* through the radial-direction gap 50 at an upper portion thereof, communicates into the shield outside gap 20 through the shield auxiliary slit 37 at a center portion thereof in the axial direction, and communicates into the shield outside gap 20 through the shield main slit 36 at a lower portion thereof. This space is also adjacent to the back face of the top cryopanel 41 on an upper side thereof in the axial direction, is adjacent to the shield upper portion 38 at an outside thereof in the radial direction, and is adjacent to a first lower cryopanel side surface 42*b* at an inside thereof in the radial direction.

The first lower cryopanel side surface 42*b* is a conical inclined surface and has the first lower cryopanel outer circumferential end 42*a* on the outermost side of the first lower cryopanel side surface 42*b* in the radial direction. The first lower cryopanel outer circumferential end 42*a* is also a lower end of the first lower cryopanel 42 in the axial direction. Note that the first lower cryopanel side surface 42*b* may be a cylindrical surface. A first lower cryopanel center portion 42*c* is arranged on an inner side in the radial direction from an upper end of the first lower cryopanel side surface 42*b* in the axial direction. The first lower cryopanel center portion 42*c* is attached directly to the upper surface of the second stage 24 of the refrigerator 16 and is thermally connected to the second stage 24.

The first lower cryopanel outer circumferential end 42*a* is covered with the top cryopanel 41 so as not to be visually recognized from the shield main opening 31. In this way, the first lower cryopanel outer circumferential end 42*a* is located much further on an inner side in the radial direction than the top cryopanel outer circumferential end 41*a*. This can enlarge the space directly below the top cryopanel 41.

The first lower cryopanel outer circumferential end 42*a* is located between the top cryopanel 41 and the shield main slit 36 in the axial direction. Thus, the first lower cryopanel 42, as well as the shield auxiliary slit 37, is located above the shield main slit 36. Accordingly, the first lower cryopanel 42 can receive gases entering from the shield auxiliary slit 37 efficiently. Also, a major amount of gas entering from the shield main slit 36 into the shield cavity lower portion 33*b* obliquely downward passes under the first lower cryopanel outer circumferential end 42*a*. Thus, this gas can head for the second lower cryopanel 43.

The second lower cryopanel 43 and the radiation shield 30 forma second radial-direction interspace 54 therebetween. The second radial-direction interspace 54 is formed between a second lower cryopanel outer circumferential end 43*a* and the shield lower portion 40. The second radial-direction interspace 54 is longer than the radial-direction gap 50. In this way, a relatively large annular accommodation volume of the condensing layer is formed. This volume is part of the shield cavity lower portion 33*b* and forms an annular space portion 60 together with the space directly below the top cryopanel 41.

This vacant space communicates into the shield outside gap 20 through the shield main slit 36 at an outer side thereof in the radial direction at an upper portion thereof, communicates into a central space portion 56 at an inner side thereof in the radial direction at the upper portion thereof, and communicates into a bottom gap 58 at a lower portion thereof. This space is adjacent to the shield lower portion 40 on an outer side thereof in the radial direction, is adjacent to a second lower cryopanel side surface 43*b* and the connection cryopanel 45 on an inside thereof in the radial direction, and is adjacent to the bottom cryopanel 44 and the shield bottom portion 34 on a lower side thereof in the axial direction.

The second lower cryopanel side surface 43*b* is a conical inclined surface and has the second lower cryopanel outer circumferential end 43*a* on the outermost side of the second lower cryopanel side surface 43*b* in the radial direction. A second lower cryopanel center portion 43*c* is arranged on an inner side in the radial direction from an upper end of the second lower cryopanel side surface 43*b* in the axial direction. The second lower cryopanel center portion 43*c* is also an upper end of the second lower cryopanel 43 in the axial direction. The second lower cryopanel center portion 43*c* is attached to the connection cryopanel 45. The second lower cryopanel 43 is thermally connected to the second stage 24 via the connection cryopanel 45.

The bottom cryopanel 44 is a disc-like member arranged perpendicularly to the axial direction. The bottom cryopanel 44 may be provided on both surfaces thereof with adsorbents. The bottom cryopanel 44 and the shield bottom portion 34 form the bottom gap 58 therebetween.

The bottom cryopanel 44 includes a bottom cryopanel outer circumferential end 44*a* located below the shield main slit 36 in the axial direction. The bottom cryopanel 44 is proximate to the shield bottom portion 34. A distance 65 from the bottom cryopanel outer circumferential end 44*a* to the radiation shield 30 (for example, the shield bottom portion 34) is comparable (for example, twice or less) to a width of the shield main slit 36. Thus, a certain amount of gas can be guided to the bottom gap 58. Also, the bottom cryopanel 44 has a bottom cryopanel center opening 44*b*.

The connection cryopanel 45 extends from the second stage 24 to the bottom cryopanel 44 and thermally connects the bottom cryopanel 44 to the second stage 24. An upper end of the connection cryopanel 45 is attached to the second stage 24 while a lower end thereof is attached to the bottom cryopanel 44.

The connection cryopanel 45 is a pair of elongated plate-like members extending in the axial direction on both sides of the second stage 24 in the radial direction. A central space portion 56 is formed between mutually opposed inner surfaces of these plate-like members. The central space portion 56 is adjacent to the inner surface of the connection cryopanel 45 in the radial direction and is adjacent to a lower side of the second stage 24 in the axial direction. The central space portion 56 can also be used as an accommodation volume of the condensing layer.

In addition to the above description, the cryopump 10 has several additional significant structural characteristics. These characteristics also contribute to improvement in a gas capacity limit. The characteristics will be described below with reference to FIGS. 3 to 5.

Figure 3:
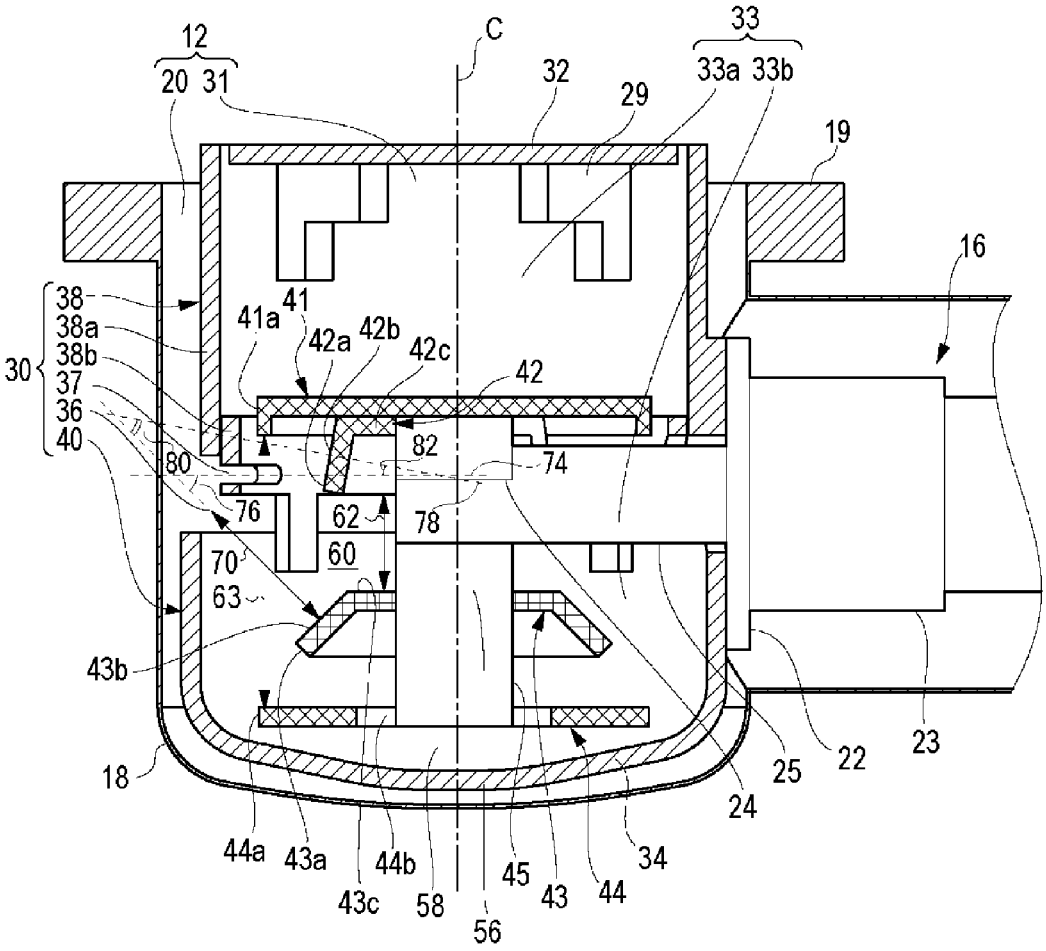
FIG. 3 is a partial cross-sectional view schematically illustrating a structural characteristic of the cryopump according to an embodiment of the present invention.

As illustrated in FIG. 3, an axial-direction cryopanel gap 62 between the lower end of the first lower cryopanel 42 in the axial direction and the upper end of the second lower cryopanel 43 in the axial direction is 40% or higher of a radial-direction distance from a center of the top cryopanel 41 to the top cryopanel outer circumferential end 41*a*. That is, the axial-direction cryopanel gap 62 is 20% or higher of the diameter of the top cryopanel 41. In this way, by separating the two cryopanels from each other, a relatively large accommodation volume of the condensing layer can be provided in the axial direction in the shield cavity lower portion 33*b*.

The annular space portion 60 is formed between the top cryopanel outer circumferential end 41*a* and the bottom cryopanel outer circumferential end 44*a*. The top cryopanel outer circumferential end 41*a* is directly opposed to the bottom cryopanel outer circumferential end 44*a* with the annular space portion 60 interposed therebetween. Since the top cryopanel 41 is located on the upper side of the shield main slit 36, the annular space portion 60 provides a relatively large accommodation volume of the condensing layer spreading to both sides of the shield main slit 36 in the axial direction.

An axial-direction gap 63 from the top cryopanel outer circumferential end 41*a* to the bottom cryopanel outer circumferential end 44*a* is equal to or longer than the radial-direction distance from the center of the top cryopanel 41 to the top cryopanel outer circumferential end 41*a* (for example, the radius of the top cryopanel 41). This helps to enlarge the annular space portion 60. The axial-direction gap 63 is also shorter than an axial-direction distance from the top cryopanel outer circumferential end 41*a* to the shield bottom portion 34. In this way, the bottom cryopanel 44 can be arranged to be in a non-contact state with the shield bottom portion 34.

The central space portion 56 communicates into the annular space portion 60 through the axial-direction cryopanel gap 62 between the first lower cryopanel 42 and the second lower cryopanel 43. Since the central space portion 56 can receive gases from the annular space portion 60, the central space portion 56 can be used as an accommodation volume of the condensing layer effectively.

The central space portion 56 also communicates into the bottom gap 58 through the bottom cryopanel center opening 44*b*. This also helps gas flow into the central space portion 56.

Figure 4:
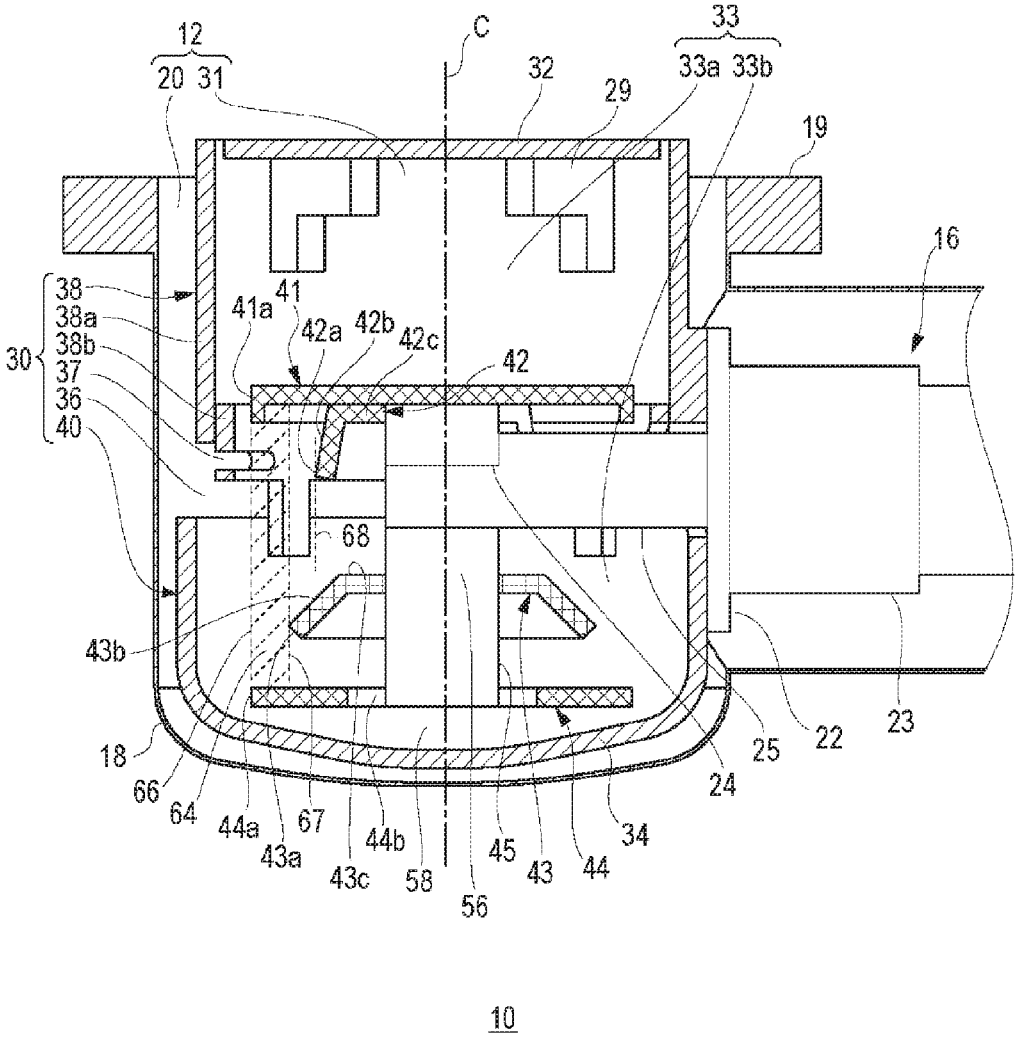
FIG. 4 is a partial cross-sectional view schematically illustrating a structural characteristic of a cryopump according to an embodiment of the present invention.

As illustrated in FIG. 4, the annular space portion 60 includes a cryopanel-less zone 64. In terms of the radial direction, the cryopanel-less zone 64 is defined between a tangent line 67 to the second lower cryopanel outer circumferential end 43*a* parallel to the axial direction and the tangent line 66 to the top cryopanel outer circumferential end 41*a* parallel to the axial direction. In terms of the axial direction, the cryopanel-less zone 64 is defined between the top cryopanel 41 and the bottom cryopanel 44 (or the second lower cryopanel 43). The cryopanel-less zone 64 is an annular region extending in the circumferential direction.

The first lower cryopanel outer circumferential end 42*a* is located further on an inner side in the radial direction than the cryopanel-less zone 64, and the first lower cryopanel 42 is thus located further on the inner side in the radial direction than the cryopanel-less zone 64. Also, the connection cryopanel 45 is located further on the inner side in the radial direction than the cryopanel-less zone 64. In the cryopump 10, there are no cryopanels inserted into the cryopanel-less zone 64.

In a typical cryopump, multiple cryopanels are densely arranged to increase the gas capacity. In this case, gaps between the cryopanels are considerably narrow. When the condensing layer grows on the cryopanels, the condensing layer is easily concentrated at an inlet of the cryopanel gap. The inlet is closed by the condensing layer, and a space is left in a deep portion of the cryopanel gap. Accordingly, as long as a common-sense design of densely arranging multiple cryopanels is employed, use efficiency of the internal space of the cryopump cannot be improved sufficiently.

Conversely, in the cryopump 10, a small number of second cryopanels are arranged outside the cryopanel-less zone 64 so as to secure the cryopanel-less zone 64. By doing so, the use rate of the internal space of the cryopump can be improved, and the gas capacity limit of the cryopump 10 can be improved.

Note that the cryopanel-less zone 64 may be defined between a tangent line 68 to the first lower cryopanel outer circumferential end 42*a* parallel to the axial direction and the tangent line 66 to the top cryopanel outer circumferential end 41*a* parallel to the axial direction. The second lower cryopanel outer circumferential end 43*a* may be located further on the inner side in the radial direction than the cryopanel-less zone 64.

The growth speed of the condensing layer on a certain second cryopanel correlates with the size (for example, the slit width) of a gas inlet located close to the second cryopanel. For example, when the slit width is long, the condensing layer grows fast on the second cryopanel opposed to the slit. Also, the growth speed of the condensing layer is influenced by the distance between a gas inlet and a second cryopanel. When the distance is short, gas condensation is concentrated on the second cryopanel, and the condensing layer grows fast.

Accordingly, by adjusting the distance from a gas inlet to a second cryopanel in accordance with the size of the gas inlet, the growth speed of the condensing layer on the second cryopanel can be adjusted. For example, a second cryopanel opposed to a large gas inlet is arranged away from the large gas inlet while another second cryopanel opposed to another small gas inlet is arranged close to the small gas inlet. By doing so, the difference in growth speed of the condensing layer on the two second cryopanels caused by the difference in size between the gas inlets and the difference in growth speed of the condensing layer caused by the difference in distance cancel each other out. In this way, the growth speed of the condensing layer on the two second cryopanels can be equalized.

A second distance (for example, a normal line 70 of the shield main slit 36 illustrated in FIG. 3) from the shield main slit 36 to the second lower cryopanel 43 is longer than a first distance (for example, the first radial-direction interspace 52 illustrated in FIG. 2) from the shield auxiliary slit 37 to the first lower cryopanel 42. Further, as described above, the shield main slit 36 has a longer width than the shield auxiliary slit 37. By doing so, the difference in growth speed of the condensing layer between the first lower cryopanel 42 and the second lower cryopanel 43 can be reduced.

An angular position of a second cryopanel with respect to a gas inlet also influences the growth speed of the condensing layer on the second cryopanel. For example, when a second cryopanel is located on a normal line of a slit (that is, when the cryopanel is opposed to the slit), the condensing layer grows fast. Conversely, when a second cryopanel is located out of a normal line of a slit, the condensing layer grows slowly.

As illustrated in FIG. 3, the second lower cryopanel 43 is arranged to intersect with the normal line 70 of the shield main slit 36. In this way, the second lower cryopanel 43 is arranged at the front of the shield main slit 36. This helps to accelerate gas condensation on the second lower cryopanel 43. Note that the first lower cryopanel 42 may be arranged to intersect with a normal line of the shield auxiliary slit 37.

An angle of the normal line 74 of the shield auxiliary slit 37 with respect to the radial direction (in the case of the illustrated embodiment, the normal line 74 corresponds to the radial direction, and the angle is zero) is smaller than an angle 76 of the normal line 70 of the shield main slit 36 with respect to the radial direction. In this way, the normal line 74 of the shield auxiliary slit 37 is set in the radial direction or in a direction close to the radial direction, and the normal line 70 of the shield main slit 36 is set in a direction away from the radial direction or in the axial direction. Thus, gases coming from the shield auxiliary slit 37 can be headed for the first lower cryopanel 42 while gases coming from the shield main slit 36 can be headed for the second lower cryopanel 43.

Also, an angle between the normal line 70 of the shield main slit 36 and a normal line of the second lower cryopanel side surface 43*b* (in the case of the illustrated embodiment, the lines correspond to each other, and the angle is zero) may be smaller than an angle 80 between the normal line 70 of the shield main slit 36 and a normal line 78 of the first lower cryopanel side surface 42*b*. Also, an angle 82 between the normal line 74 of the shield auxiliary slit 37 and the normal line 78 of the first lower cryopanel side surface 42*b* may be smaller than an angle 76 between the normal line 74 of the shield auxiliary slit 37 and the normal line of the second lower cryopanel side surface 43*b* (in the case of the illustrated embodiment, the normal line 70 of the shield main slit 36). In this way, the first lower cryopanel 42 may be arranged on the front of the shield auxiliary slit 37, and the second lower cryopanel 43 may be arranged on the front of the shield main slit 36.

A parameter "a gas capacity limit value" may be used to design equalization of the growth speed of the condensing layer on the cryopanels. The gas capacity limit value is calculated based on a slit width, a distance between the slit and a cryopanel, and an angular position of the cryopanel with respect to the slit.

The gas capacity limit value for a combination of a certain cryopanel and a certain gas inlet may be calculated by the following equation:

$$\text{Gas capacity limit value} = L/(S \cdot \cos\theta)$$

where L is a slit width, S is a distance between the slit and a representative point of the cryopanel, and θ is an angular position of the representative point of the cryopanel with respect to the slit.

In a case in which this gas capacity limit value is high, the growth speed of the condensing layer on the cryopanel is high. In a case in which the gas capacity limit values of respective cryopanels are similar, the condensing layers will grow on the respective cryopanels uniformly.

Figure 5:
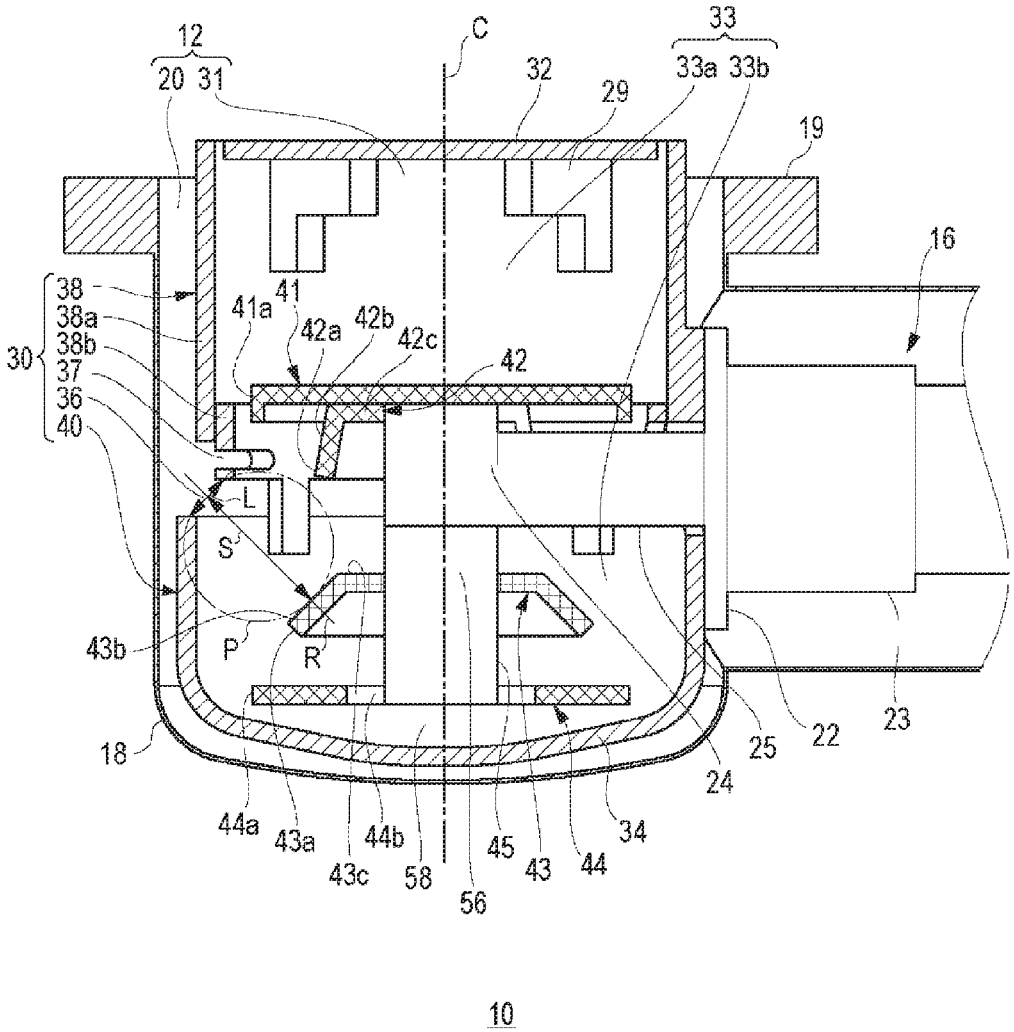
FIG. 5 is a partial cross-sectional view schematically illustrating a structural characteristic of a cryopump according to an embodiment of the present invention.

As an example, a second main slit gas capacity limit value for a combination of the shield main slit 36 and the second lower cryopanel 43 is calculated in the following procedure with reference to FIG. 5. First, both ends of a cross-section of the shield main slit 36 are connected by a line segment L. A normal line R (that is, the normal line of the shield main slit 36) is drawn from a center of the line segment L (that is, a center of the shield main slit 36). A circle P having a center thereof on the line R, passing both the ends of the line segment L, and being tangent to the second lower cryopanel 43 is formed. A tangent point between the second lower cryopanel 43 and the circle P is regarded as "a representative point" of the second lower cryopanel 43. A line segment S connecting the center of the line segment L to the representative point of the second lower cryopanel 43 is drawn.

At this time, the second main slit gas capacity limit value may be defined by the following equation:

$$\text{Second main slit gas capacity limit value}=l/(s\cdot\cos\theta)$$

where l is a length of the line segment L (that is, a main slit width), s is a length of the line segment S (that is, a distance between the shield main slit 36 and the representative point of the second lower cryopanel 43), and θ is an angle between the normal line R and the line segment S (that is, an angular position of the representative point of the second lower cryopanel 43 with respect to the shield main slit 36). Meanwhile, in the case of FIG. 5, θ=90° since the line segment S corresponds to the normal line R.

Note that "a representative point" of a certain cryopanel may be an arbitrary position such as an end point and a center point of the cryopanel.

A first main slit gas capacity limit value for a combination of the shield main slit 36 and the first lower cryopanel 42 is calculated in a similar method. In this case, a circle P' having a center thereof on a line R, passing both ends of a line segment L, and being tangent to the first lower cryopanel 42 is formed. A tangent point between the first lower cryopanel 42 and the circle P' is regarded as "a representative point" of the first lower cryopanel 42. A line segment S' connecting the center of the line segment L to a representative point of the first lower cryopanel 42 is drawn. In the case of the illustrated embodiment, the representative point corresponds to the first lower cryopanel outer circumferential end 42*a*. The first main slit gas capacity limit value may be defined by the following equation:

$$\text{First main slit gas capacity limit value}=l/(s'\cdot\cos\theta')$$

where s' is a length of the line segment S' (that is, a distance between the shield main slit 36 and the representative point of the first lower cryopanel 42), and θ' is an angle between the normal line R and the line segment S' (that is, an angular position of the representative point of the first lower cryopanel 42 with respect to the shield main slit 36). Meanwhile, in FIG. 5, illustration of the circle P' and the line segment S' is omitted for simplification.

Similarly, a first auxiliary slit gas capacity limit value for a combination of the shield auxiliary slit 37 and the first lower cryopanel 42 is calculated based on an auxiliary slit width, a distance from the shield auxiliary slit 37 to the first lower cryopanel 42, and an angular position of the first lower cryopanel 42 with respect to the shield auxiliary slit 37. A second auxiliary slit gas capacity limit value for a combination of the shield auxiliary slit 37 and the second lower cryopanel 43 is calculated based on an auxiliary slit width, a distance from the shield auxiliary slit 37 to the second lower cryopanel 43, and an angular position of the second lower cryopanel 43 with respect to the shield auxiliary slit 37.

In the cryopump 10, a first total gas capacity limit value is substantially equal to a second total gas capacity limit value. The first total gas capacity limit value is a sum of the first auxiliary slit gas capacity limit value and the first main slit gas capacity limit value. The second total gas capacity limit value is a sum of the second auxiliary slit gas capacity limit value and the second main slit gas capacity limit value. In this way, by designing the cryopump so that the sum of the gas capacity limit values in each cryopanel may be equal, the growth speed of the condensing layer on the cryopanels can be equalized.

A difference between the first total gas capacity limit value and the second total gas capacity limit value may be, for example, within 5%, 3%, or 1% of the first total gas capacity limit value.

An explanation on the operations of the cryopump 10 with the aforementioned configuration will be given below. Before activating the cryopump 10, the inside of the vacuum chamber is first roughly evacuated to, for example, approximately 1 Pa by using an appropriate roughing pump. The cryopump 10 is then activated. The operation of the refrigerator 16 cools the first stage 22 and the second stage 24, and that also cools the first cryopanel and the second cryopanel thermally connected to these stages. The first cryopanel and the second cryopanel are cooled to the first cooling temperature and the second cooling temperature, respectively.

Some of the gases flowing from the vacuum chamber into the cryopump 10 collide with the plate member 32, and other gases enter the shield cavity upper portion 33*a* through the pores 32*a* of the plate member 32. Also, other gases enter the shield cavity lower portion 33*b* through the shield main slit 36 or the shield auxiliary slit 37 from the shield outside gap 20 around the plate member 32.

Type I gases (for example, water) having vapor pressures that are sufficiently reduced by the first cooling temperature are condensed on a surface of the first cryopanel. Type II gases (for example, argon) having vapor pressures that are sufficiently reduced by the second cooling temperature are condensed on a surface of the second cryopanel. Type III gases (for example, hydrogen) having vapor pressures that are not sufficiently reduced by the second cooling temperature are adsorbed onto the adsorbent that is cooled on the surface of the second cryopanel. In this way, the cryopump 10 can pump the vacuum chamber and attain a desired degree of vacuum in the vacuum chamber.

Since the cryopump 10 has the various structural characteristics, the growth speed of the condensing layer of the type II gases is equalized. Accordingly, concentration of condensation of the type II gases only on a specific cryopanel (for example, the top cryopanel 41) is avoided. The type II gases are condensed on the respective cryopanels uniformly, and the use rate of the internal space of the cryopump is extremely high. When the condensing layer of the type II gases grows and contacts the first cryopanel, the shield cavity 33 contains almost no space. Thus, the gas capacity limit of the cryopump 10 is increased.

The above has described the present invention based on embodiments. Those skilled in the art will appreciate that the present invention is not limited to the embodiments described above, that various design changes and modifications are possible, and that such modifications are also within the scope of the present invention.

For example, at least one additional second cryopanel may be provided between the top cryopanel and the inlet cryopanel. At least one additional second cryopanel may be provided between the bottom cryopanel and the shield bottom portion. The additional second cryopanel may be smaller (for example, smaller in diameter) than the top cryopanel and/or bottom cryopanel.

The top cryopanel and at least one second cryopanel adjacent to the top cryopanel (for example, the first lower cryopanel) may form an integrated cryopanel member. The bottom cryopanel and at least one second cryopanel adjacent to the bottom cryopanel (for example, the second lower cryopanel) may form an integrated cryopanel member.

One out of the bottom cryopanel and the second lower cryopanel may not be provided. The second lower cryopanel may also function as the bottom cryopanel. Alternatively, neither the bottom cryopanel nor the second lower cryopanel may be provided. Additionally or instead, the first lower cryopanel may not be provided.

The cross-section(s), perpendicular to the axial direction, of the first cryopanel such as the radiation shield 30 and/or the second cryopanel such as the top cryopanel 41 may be non-circular. For example, the cross-section(s) may be polygonal such as rectangle or elliptical.

The embodiments of the present invention can also be expressed in the following manner.

1. A cryopump comprising:

a cryopump housing that includes a cryopump inlet;

a refrigerator that includes a high-temperature cooling stage and a low-temperature cooling stage housed in the cryopump housing;

a radiation shield that includes a shield main opening at the cryopump inlet, that defines a shield cavity continuing from the shield main opening in an axial direction, that is thermally connected to the high-temperature cooling stage, that receives the low-temperature cooling stage in the shield cavity, and that forms a shield outside gap between the radiation shield and the cryopump housing; and a plurality of cryopanels that are each thermally connected to the low-temperature cooling stage and that are each arranged in the shield cavity in a non-contact state with the radiation shield, wherein the plurality of cryopanels include a top cryopanel that partitions the shield cavity into a shield cavity upper portion and a shield cavity lower portion, and the radiation shield further includes a shield main slit that communicates the shield outside gap into the shield cavity lower portion and a shield auxiliary slit that is formed at a different position from that of the shield main slit in the axial direction and that communicates the shield outside gap into the shield cavity lower portion.

2. The cryopump according to embodiment 1, wherein the shield auxiliary slit is formed between the top cryopanel and the shield main slit in the axial direction.

3. The cryopump according to embodiment 2, wherein the radiation shield includes a shield upper portion enclosing the shield cavity upper portion and a shield lower portion enclosing the shield cavity lower portion, the shield main slit is defined between a lower end of the shield upper portion and an upper end of the shield lower portion, and the shield auxiliary slit is provided to penetrate the lower end of the shield upper portion.

4. The cryopump according to any one of embodiments 1 to 3, wherein the top cryopanel and the radiation shield form a radial-direction gap therebetween, the plurality of cryopanels further include a first lower cryopanel arranged in the shield cavity lower portion, and the first lower cryopanel includes a first lower cryopanel outer circumferential end that forms a first radial-direction interspace between the first lower cryopanel outer circumferential end and the radiation shield, and the first radial-direction interspace is wider than the radial-direction gap.

5. The cryopump according to embodiment 4, wherein the first lower cryopanel outer circumferential end is covered with the top cryopanel such as to be invisible from the shield main opening.

6. The cryopump according to embodiment 4 or 5, wherein the first lower cryopanel outer circumferential end is located between the top cryopanel and the shield main slit in the axial direction.

7. The cryopump according to any one of embodiments 4 to 6, wherein the radiation shield includes a shield bottom portion on a side opposite to the shield main opening in the axial direction, and the plurality of cryopanels further include a second lower cryopanel arranged between the first lower cryopanel and the shield bottom portion in the axial direction.

8. The cryopump according to embodiment 7, wherein the shield main slit has a main slit width while the shield auxiliary slit has an auxiliary slit width, and the main slit width is longer than the auxiliary slit width, and a second distance from the shield main slit to the second lower cryopanel is longer than a first distance from the shield auxiliary slit to the first lower cryopanel.

9. The cryopump according to embodiment 8, wherein a first total gas capacity limit value that is a sum of a first auxiliary slit gas capacity limit value based on the auxiliary slit width, the first distance, and an angular position of the first lower cryopanel with respect to the shield auxiliary slit and a first main slit gas capacity limit value based on the main slit width, a distance from the shield main slit to the first lower cryopanel, and an angular position of the first lower cryopanel with respect to the shield main slit is equal to a second total gas capacity limit value that is a sum of a second main slit gas capacity limit value based on the main slit width, the second distance, and an angular position of the second lower cryopanel with respect to the shield main slit and a second auxiliary slit gas capacity limit value based on the auxiliary slit width, a distance from the shield auxiliary slit to the second lower cryopanel, and an angular position of the second lower cryopanel with respect to the shield auxiliary slit.

10. The cryopump according to any one of embodiments 7 to 9, wherein the first lower cryopanel has a first radius while the second lower cryopanel has a second radius, and the second radius is longer than the first radius.

11. The cryopump according to any one of embodiments 7 to 10, wherein the second lower cryopanel is arranged to intersect with a normal line of the shield main slit.

12. The cryopump according to any one of embodiments 7 to 11, wherein the first lower cryopanel includes a first lower cryopanel side surface while the second lower cryopanel includes a second lower cryopanel side surface, an angle between a normal line of the shield main slit and a normal line of the second lower cryopanel side surface is smaller than an angle between the normal line of the shield main slit and a normal line of the first lower cryopanel side surface, and an angle between a normal line of the shield auxiliary slit and the normal line of the first lower cryopanel side surface is smaller than an angle between the normal line of the shield auxiliary slit and the normal line of the second lower cryopanel side surface.

13. The cryopump according to any one of embodiments 1 to 12, wherein an angle of a normal line of the shield auxiliary slit with respect to a radial direction is smaller than an angle of a normal line of the shield main slit with respect to the radial direction.

14. A cryopump comprising:

a cryopump housing that includes a cryopump inlet;

a refrigerator that includes a high-temperature cooling stage and a low-temperature cooling stage housed in the cryopump housing;

a radiation shield that includes a shield main opening at the cryopump inlet, that defines a shield cavity continuing from the shield main opening in an axial direction, that is thermally connected to the high-temperature cooling stage, that receives the low-temperature cooling stage in the shield cavity, and that forms a shield outside gap between the radiation shield and the cryopump housing; and a plurality of cryopanels that are each thermally connected to the low-temperature cooling stage and that are each arranged in the shield cavity in a non-contact state with the radiation shield, wherein the plurality of cryopanels include a top cryopanel that partitions the shield cavity into a shield cavity upper portion and a shield cavity lower portion and a first lower cryopanel arranged in the shield cavity lower portion, the radiation shield further includes a shield main slit that communicates the shield outside gap into the shield cavity lower portion, the top cryopanel and the radiation shield form a radial-direction gap therebetween, and the first lower cryopanel includes a first lower cryopanel outer circumferential end that forms a first radial-direction interspace between the first lower cryopanel outer circumferential end and the radiation shield, and the first radial-direction interspace is wider than the radial-direction gap.

15. The cryopump according to embodiment 14, wherein the first lower cryopanel outer circumferential end is covered with the top cryopanel such as to be invisible from the shield main opening.

16. The cryopump according to embodiment 14 or 15, wherein the first lower cryopanel outer circumferential end is located between the top cryopanel and the shield main slit in the axial direction.

17. The cryopump according to any one of embodiments 14 to 16, wherein the radiation shield further includes a shield auxiliary slit that is formed at a different position from that of the shield main slit in the axial direction and that communicates the shield outside gap into the shield cavity lower portion.

18. The cryopump according to embodiment 17, wherein the shield auxiliary slit is formed between the top cryopanel and the shield main slit in the axial direction.

19. The cryopump according to embodiment 18, wherein the radiation shield includes a shield upper portion enclosing the shield cavity upper portion and a shield lower portion enclosing the shield cavity lower portion, the shield main slit is defined between a lower end of the shield upper portion and an upper end of the shield lower portion, and the shield auxiliary slit is provided to penetrate the lower end of the shield upper portion.

20. The cryopump according to any one of embodiments 17 to 19, wherein an angle of a normal line of the shield auxiliary slit with respect to a radial direction is smaller than an angle of a normal line of the shield main slit with respect to the radial direction.

21. The cryopump according to any one of embodiments 17 to 20, wherein the radiation shield includes a shield bottom portion on a side opposite to the shield main opening in the axial direction, and the plurality of cryopanels further include a second lower cryopanel arranged between the first lower cryopanel and the shield bottom portion in the axial direction.

22. The cryopump according to embodiment 21, wherein the shield main slit has a main slit width while the shield auxiliary slit has an auxiliary slit width, and the main slit width is longer than the auxiliary slit width, and a second distance from the shield main slit to the second lower cryopanel is longer than a first distance from the shield auxiliary slit to the first lower cryopanel.

23. The cryopump according to embodiment 22, wherein a first total gas capacity limit value that is a sum of a first auxiliary slit gas capacity limit value based on the auxiliary slit width, the first distance, and an angular position of the first lower cryopanel with respect to the shield auxiliary slit and a first main slit gas capacity limit value based on the main slit width, a distance from the shield main slit to the first lower cryopanel, and an angular position of the first lower cryopanel with respect to the shield main slit is equal to a second total gas capacity limit value that is a sum of a second main slit gas capacity limit value based on the main slit width, the second distance, and an angular position of the second lower cryopanel with respect to the shield main slit and a second auxiliary slit gas capacity limit value based on the auxiliary slit width, a distance from the shield auxiliary slit to the second lower cryopanel, and an angular position of the second lower cryopanel with respect to the shield auxiliary slit.

24. The cryopump according to any one of embodiments 21 to 23, wherein the first lower cryopanel has a first radius while the second lower cryopanel has a second radius, and the second radius is longer than the first radius.

25. The cryopump according to any one of embodiments 21 to 24, wherein the second lower cryopanel is arranged to intersect with a normal line of the shield main slit.

26. The cryopump according to any one of embodiments 21 to 25, wherein the first lower cryopanel includes a first lower cryopanel side surface while the second lower cryopanel includes a second lower cryopanel side surface, an angle between a normal line of the shield main slit and a normal line of the second lower cryopanel side surface is smaller than an angle between the normal line of the shield main slit and a normal line of the first lower cryopanel side surface, and an angle between a normal line of the shield auxiliary slit and the normal line of the first lower cryopanel side surface is smaller than an angle between the normal line of the shield auxiliary slit and the normal line of the second lower cryopanel side surface.

27. The cryopump according to any one of embodiments 1 to 26, wherein the top cryopanel includes a top cryopanel outer circumferential end located axially above the shield main slit, the plurality of cryopanels further include a bottom cryopanel that includes a bottom cryopanel outer circumferential end located axially below the shield main slit, and an annular vacant space is formed between the top cryopanel outer circumferential end and the bottom cryopanel outer circumferential end and the top cryopanel outer circumferential end is directly opposed to the bottom cryopanel outer circumferential end with the annular vacant space interposed therebetween.

28. The cryopump according to embodiment 27, wherein an axial-direction distance from the top cryopanel outer circumferential end to the bottom cryopanel outer circumferential end is equal to or longer than a radial-direction distance from a center of the top cryopanel to the top cryopanel outer circumferential end.

29. The cryopump according to embodiment 27 or 28, wherein the radiation shield includes a shield front end that defines the shield main opening, and a radial-direction distance from a center of the top cryopanel to the top cryopanel outer circumferential end is 70% or higher of a radial-direction distance from a center of the shield main opening to the shield front end.

30. The cryopump according to any one of embodiments 27 to 29, wherein a distance from the bottom cryopanel outer circumferential end to the radiation shield is twice or less of a width of the shield main slit.

31. The cryopump according to any one of embodiments 27 to 30, wherein the plurality of cryopanels further include a first lower cryopanel arranged between the top cryopanel and the bottom cryopanel in the axial direction and a second lower cryopanel arranged between the first lower cryopanel and the bottom cryopanel in the axial direction, and an axial-direction cryopanel interspace between a lower end of the first lower cryopanel in the axial direction and an upper end of the second lower cryopanel in the axial direction is 40% or higher of a radial-direction distance from a center of the top cryopanel to the top cryopanel outer circumferential end.

32. The cryopump according to embodiment 31, wherein the first lower cryopanel is covered with the top cryopanel such as to be invisible from the shield main opening.

33. The cryopump according to embodiment 31 or 32, wherein the second lower cryopanel is arranged further inward in a radial direction than a tangent line to the top cryopanel outer circumferential end parallel to the axial direction.

34. The cryopump according to any one of embodiments 27 to 33, wherein the refrigerator is arranged along a radial direction, the plurality of cryopanels further include a connection cryopanel that extends from the low-temperature cooling stage to the bottom cryopanel and that thermally connects the bottom cryopanel to the low-temperature cooling stage, and a central vacant space that is adjacent to an inner surface of the connection cryopanel in the radial direction and that is adjacent to a lower side of the low-temperature cooling stage in the axial direction is formed.

35. The cryopump according to embodiment 34, wherein the plurality of cryopanels further include a first lower cryopanel arranged between the top cryopanel and the bottom cryopanel in the axial direction and a second lower cryopanel arranged between the first lower cryopanel and the bottom cryopanel in the axial direction, and the central vacant space communicates into the annular vacant space through an axial-direction cryopanel interspace between a lower end of the first lower cryopanel in the axial direction and an upper end of the second lower cryopanel in the axial direction.

36. The cryopump according to embodiment 34 or 35, wherein the radiation shield includes a shield bottom portion on a side opposite to the shield main opening in the axial direction, the bottom cryopanel has a bottom cryopanel center opening, and the central vacant space communicates into a bottom gap formed between the shield bottom portion and the bottom cryopanel through the bottom cryopanel center opening.

37. The cryopump according to any one of embodiments 27 to 36, wherein the plurality of cryopanels further include a first lower cryopanel arranged between the top cryopanel and the bottom cryopanel in the axial direction and a second lower cryopanel arranged between the first lower cryopanel and the bottom cryopanel in the axial direction, the top cryopanel outer circumferential end forms a radial-direction gap between the top cryopanel outer circumferential end and the radiation shield, the first lower cryopanel includes a first lower cryopanel outer circumferential end that forms a first radial-direction interspace wider than the radial-direction gap between the first lower cryopanel outer circumferential end and the radiation shield, and the second lower cryopanel includes a second lower cryopanel outer circumferential end that forms a second radial-direction interspace wider than the radial-direction gap between the second lower cryopanel outer circumferential end and the radiation shield, the annular vacant space includes a cryopanel-less zone that is defined between a tangent line to one of the first lower cryopanel outer circumferential end and the second lower cryopanel outer circumferential end parallel to the axial direction and a tangent line to the top cryopanel outer circumferential end parallel to the axial direction, and the other of the first lower cryopanel outer circumferential end and the second lower cryopanel outer circumferential end is located further on an inner side in the radial direction than the cryopanel-less zone.

It should be understood that the invention is not limited to the above-described embodiment, but may be modified into various forms on the basis of the spirit of the invention. Additionally, the modifications are included in the scope of the invention.

What is claimed is:

1. A cryopump comprising:

a cryopump housing that includes a cryopump inlet;

a refrigerator that includes a high-temperature cooling stage and a low-temperature cooling stage housed in the cryopump housing;

a radiation shield that includes a shield main opening at the cryopump inlet, that defines a shield cavity continuing from the shield main opening in an axial direction, that is thermally connected to the high-temperature cooling stage, that receives the low-temperature cooling stage in the shield cavity, and that forms a shield outside gap between the radiation shield and the cryopump housing; and a plurality of cryopanels that are each thermally connected to the low-temperature cooling stage and that are each arranged in the shield cavity in a non-contact state with the radiation shield, wherein the plurality of cryopanels include a top cryopanel that partitions the shield cavity into a shield cavity upper portion and a shield cavity lower portion, the radiation shield further includes a shield main slit that communicates the shield outside gap into the shield cavity lower portion and a shield auxiliary slit that is formed at a different position from that of the shield main slit in the axial direction and that communicates the shield outside gap into the shield cavity lower portion, the top cryopanel and the radiation shield form a radial-direction gap therebetween, the plurality of cryopanels further include a first lower cryopanel arranged in the shield cavity lower portion, the first lower cryopanel includes a first lower cryopanel outer circumferential end that forms a first radial-direction interspace between the first lower cryopanel outer circumferential end and the radiation shield, and the first radial-direction interspace is wider than the radial-direction gap, the radiation shield includes a shield bottom portion on a side opposite to the shield main opening in the axial direction, the plurality of cryopanels further include a second lower cryopanel arranged between the first lower cryopanel and the shield bottom portion in the axial direction, the shield main slit has a main slit width while the shield auxiliary slit has an auxiliary slit width, and the main slit width is longer than the auxiliary slit width, and a second distance from the shield main slit to the second lower cryopanel is longer than a first distance from the shield auxiliary slit to the first lower cryopanel.

2. The cryopump according to claim 1, wherein the shield auxiliary slit is formed between the top cryopanel and the shield main slit in the axial direction.

3. The cryopump according to claim 2, wherein the radiation shield includes a shield upper portion enclosing the shield cavity upper portion and a shield lower portion enclosing the shield cavity lower portion, the shield main slit is defined between a lower end of the shield upper portion and an upper end of the shield lower portion, and the shield auxiliary slit is provided to penetrate the lower end of the shield upper portion.

4. The cryopump according to claim 1, wherein the first lower cryopanel outer circumferential end is covered with the top cryopanel such as to be invisible from the shield main opening.

5. The cryopump according to claim 1, wherein the first lower cryopanel outer circumferential end is located between the top cryopanel and the shield main slit in the axial direction.

6. The cryopump according to claim 1, wherein a first total gas capacity limit value that is a sum of a first auxiliary slit gas capacity limit value based on the auxiliary slit width, the first distance, and an angular position of the first lower cryopanel with respect to the shield auxiliary slit and a first main slit gas capacity limit value based on the main slit width, a distance from the shield main slit to the first lower cryopanel, and an angular position of the first lower cryopanel with respect to the shield main slit is equal to a second total gas capacity limit value that is a sum of a second main slit gas capacity limit value based on the main slit width, the second distance, and an angular position of the second lower cryopanel with respect to the shield main slit and a second auxiliary slit gas capacity limit value based on the auxiliary slit width, a distance from the shield auxiliary slit to the second lower cryopanel, and an angular position of the second lower cryopanel with respect to the shield auxiliary slit.

7. A cryopump comprising:

a cryopump housing that includes a cryopump inlet;

a refrigerator that includes a high-temperature cooling stage and a low-temperature cooling stage housed in the cryopump housing;

a radiation shield that includes a shield main opening at the cryopump inlet, that defines a shield cavity continuing from the shield main opening in an axial direction, that is thermally connected to the high-temperature cooling stage, that receives the low-temperature cooling stage in the shield cavity, and that forms a shield outside gap between the radiation shield and the cryopump housing; and a plurality of cryopanels that are each thermally connected to the low-temperature cooling stage and that are each arranged in the shield cavity in a non-contact state with the radiation shield, wherein the plurality of cryopanels include a top cryopanel that partitions the shield cavity into a shield cavity upper portion and a shield cavity lower portion, the radiation shield further includes a shield main slit that communicates the shield outside gap into the shield cavity lower portion and a shield auxiliary slit that is formed at a different position from that of the shield main slit in the axial direction and that communicates the shield outside gap into the shield cavity lower portion, the top cryopanel and the radiation shield form a radial-direction gap therebetween, the plurality of cryopanels further include a first lower cryopanel arranged in the shield cavity lower portion, the first lower cryopanel includes a first lower cryopanel outer circumferential end that forms a first radial-direction interspace between the first lower cryopanel outer circumferential end and the radiation shield, and the first radial-direction interspace is wider than the radial-direction gap, the radiation shield includes a shield bottom portion on a side opposite to the shield main opening in the axial direction, the plurality of cryopanels further include a second lower cryopanel arranged between the first lower cryopanel and the shield bottom portion in the axial direction, and the first lower cryopanel has a first radius while the second lower cryopanel has a second radius, and the second radius is longer than the first radius.

8. A cryopump comprising:

a cryopump housing that includes a cryopump inlet;

a refrigerator that includes a high-temperature cooling stage and a low-temperature cooling stage housed in the cryopump housing;

a radiation shield that includes a shield main opening at the cryopump inlet, that defines a shield cavity continuing from the shield main opening in an axial direction, that is thermally connected to the high-temperature cooling stage, that receives the low-temperature cooling stage in the shield cavity, and that forms a shield outside gap between the radiation shield and the cryopump housing; and a plurality of cryopanels that are each thermally connected to the low-temperature cooling stage and that are each arranged in the shield cavity in a non-contact state with the radiation shield, wherein the plurality of cryopanels include a top cryopanel that partitions the shield cavity into a shield cavity upper portion and a shield cavity lower portion, the radiation shield further includes a shield main slit that communicates the shield outside gap into the shield cavity lower portion and a shield auxiliary slit that is formed at a different position from that of the shield main slit in the axial direction and that communicates the shield outside gap into the shield cavity lower portion, the top cryopanel and the radiation shield form a radial-direction gap therebetween, the plurality of cryopanels further include a first lower cryopanel arranged in the shield cavity lower portion, the first lower cryopanel includes a first lower cryopanel outer circumferential end that forms a first radial-direction interspace between the first lower cryopanel outer circumferential end and the radiation shield, and the first radial-direction interspace is wider than the radial-direction gap, the radiation shield includes a shield bottom portion on a side opposite to the shield main opening in the axial direction, the plurality of cryopanels further include a second lower cryopanel arranged between the first lower cryopanel and the shield bottom portion in the axial direction, and the second lower cryopanel is arranged to intersect with a normal line of the shield main slit, the normal line of the shield main slit being a line perpendicular to the shield main slit.

9. A cryopump comprising:

a cryopump housing that includes a cryopump inlet;

a refrigerator that includes a high-temperature cooling stage and a low-temperature cooling stage housed in the cryopump housing;

a radiation shield that includes a shield main opening at the cryopump inlet, that defines a shield cavity continuing from the shield main opening in an axial direction, that is thermally connected to the high-temperature cooling stage, that receives the low-temperature cooling stage in the shield cavity, and that forms a shield outside gap between the radiation shield and the cryopump housing; and a plurality of cryopanels that are each thermally connected to the low-temperature cooling stage and that are each arranged in the shield cavity in a non-contact state with the radiation shield, wherein the plurality of cryopanels include a top cryopanel that partitions the shield cavity into a shield cavity upper portion and a shield cavity lower portion, the radiation shield further includes a shield main slit that communicates the shield outside gap into the shield cavity lower portion and a shield auxiliary slit that is formed at a different position from that of the shield main slit in the axial direction and that communicates the shield outside gap into the shield cavity lower portion, the top cryopanel and the radiation shield form a radial-direction gap therebetween, the plurality of cryopanels further include a first lower cryopanel arranged in the shield cavity lower portion, the first lower cryopanel includes a first lower cryopanel outer circumferential end that forms a first radial-direction interspace between the first lower cryopanel outer circumferential end and the radiation shield, and the first radial-direction interspace is wider than the radial-direction gap, the radiation shield includes a shield bottom portion on a side opposite to the shield main opening in the axial direction, the plurality of cryopanels further include a second lower cryopanel arranged between the first lower cryopanel and the shield bottom portion in the axial direction, the first lower cryopanel includes a first lower cryopanel side surface while the second lower cryopanel includes a second lower cryopanel side surface, an angle between a normal line of the shield main slit and a normal line of the second lower cryopanel side surface is smaller than an angle between the normal line of the shield main slit and a normal line of the first lower cryopanel side surface, and an angle between a normal line of the shield auxiliary slit and the normal line of the first lower cryopanel side surface is smaller than an angle between the normal line of the shield auxiliary slit and the normal line of the second lower cryopanel side surface, the normal lines of the shield main slit, the shield auxiliary slit, the first lower cryopanel side surface and the second lower cryopanel side surface being lines perpendicular to the shield main slit, the shield auxiliary slit, the first lower cryopanel side surface and the second lower cryopanel side surface, respectively.

10. A cryopump comprising:

a cryopump housing that includes a cryopump inlet;

a refrigerator that includes a high-temperature cooling stage and a low-temperature cooling stage housed in the cryopump housing;

a radiation shield that includes a shield main opening at the cryopump inlet, that defines a shield cavity continuing from the shield main opening in an axial direction, that is thermally connected to the high-temperature cooling stage, that receives the low-temperature cooling stage in the shield cavity, and that forms a shield outside gap between the radiation shield and the cryopump housing; and a plurality of cryopanels that are each thermally connected to the low-temperature cooling stage and that are each arranged in the shield cavity in a non-contact state with the radiation shield, wherein the plurality of cryopanels include a top cryopanel that partitions the shield cavity into a shield cavity upper portion and a shield cavity lower portion, the radiation shield further includes a shield main slit that communicates the shield outside gap into the shield cavity lower portion and a shield auxiliary slit that is formed at a different position from that of the shield main slit in the axial direction and that communicates the shield outside gap into the shield cavity lower portion, and an angle of a normal line of the shield auxiliary slit with respect to a radial direction is smaller than an angle of a normal line of the shield main slit with respect to the radial direction, the normal lines of the shield main slit and the shield auxiliary slit being lines perpendicular to the shield main slit and the shield auxiliary slit, respectively.

11. A cryopump comprising:

a cryopump housing that includes a cryopump inlet;

a refrigerator that includes a high-temperature cooling stage and a low-temperature cooling stage housed in the cryopump housing;

a radiation shield that includes a shield main opening at the cryopump inlet, that defines a shield cavity continuing from the shield main opening in an axial direction, that is thermally connected to the high-temperature cooling stage, that receives the low-temperature cooling stage in the shield cavity, and that forms a shield outside gap between the radiation shield and the cryopump housing; and a plurality of cryopanels that are each thermally connected to the low-temperature cooling stage and that are each arranged in the shield cavity in a non-contact state with the radiation shield, wherein the plurality of cryopanels include a top cryopanel that partitions the shield cavity into a shield cavity upper portion and a shield cavity lower portion and a first lower cryopanel arranged in the shield cavity lower portion, the radiation shield further includes a shield main slit that communicates the shield outside gap into the shield cavity lower portion, the top cryopanel and the radiation shield form a radial-direction gap therebetween, the first lower cryopanel includes a first lower cryopanel outer circumferential end that forms a first radial-direction interspace between the first lower cryopanel outer circumferential end and the radiation shield, and the first radial-direction interspace is wider than the radial-direction gap, the radiation shield further includes a shield auxiliary slit that is formed at a different position from that of the shield main slit in the axial direction and that communicates the shield outside gap into the shield cavity lower portion, and an angle of a normal line of the shield auxiliary slit with respect to a radial direction is smaller than an angle of a normal line of the shield main slit with respect to the radial direction, the normal lines of the shield main slit and the shield auxiliary slit being lines perpendicular to the shield main slit and the shield auxiliary slit, respectively.

12. The cryopump according to claim 11, wherein the first lower cryopanel outer circumferential end is covered with the top cryopanel such as to be invisible from the shield main opening.

13. The cryopump according to claim 11, wherein the first lower cryopanel outer circumferential end is located between the top cryopanel and the shield main slit in the axial direction.

14. The cryopump according to claim 11, wherein the shield auxiliary slit is formed between the top cryopanel and the shield main slit in the axial direction.

15. The cryopump according to claim 11, wherein the radiation shield includes a shield bottom portion on a side opposite to the shield main opening in the axial direction, and the plurality of cryopanels further includes a second lower cryopanel arranged between the first lower cryopanel and the shield bottom portion in the axial direction.

* * * * *